United States Patent [19]

Bresnahan

[11] Patent Number: 5,059,062

[45] **Date of Patent: * Oct. 22, 1991**

[54] CONCRETE PATH PAVER WITH REMOVEABLE SLIP-FORMING SCREED

[76] Inventor: Pat Bresnahan, 3210 W. Woodhurst St., Lecanto, Fla. 32661

[ * ] Notice: The portion of the term of this patent subsequent to Nov. 7, 2006, has been disclaimed.

[21] Appl. No.: 537,690

[22] Filed: Jun. 14, 1990

[51] Int. Cl.[5] ..... E01C 19/42; E01C 19/48

[52] U.S. Cl. ..... 404/110; 404/96; 404/105

[58] Field of Search ..... 404/110, 108, 105, 102, 404/96, 118

[56] References Cited

U.S. PATENT DOCUMENTS

| | | | |
|---|---|---|---|
| 1,401,149 | 12/1921 | Foster | 404/110 |
| 1,767,243 | 6/1930 | Kime | 404/110 |
| 2,990,754 | 4/1961 | Beeson | 404/96 |
| 3,080,796 | 3/1963 | McCullough et al. | 404/96 |
| 3,373,669 | 3/1968 | Schmitz | 404/110 |
| 3,456,566 | 7/1969 | Lazaro | 404/108 |
| 4,492,490 | 1/1985 | Christine et al. | 404/108 |
| 4,526,493 | 7/1985 | Hall et al. | 404/108 X |
| 4,802,788 | 2/1989 | Smith | 404/105 X |
| 4,878,778 | 11/1989 | Bresnahan | 404/110 X |

*Primary Examiner*—Ramon S. Britts
*Assistant Examiner*—Nancy P. Connolly
*Attorney, Agent, or Firm*—Dominik, Stein et al.

[57] ABSTRACT

Apparatus for slip-forming concrete to form a path comprising in combination a box having a front wall extending downwardly through the box, and a rear wall extending downwardly at an angle through the box to a location above the front wall, and opposing side walls coupling the front and rear walls extending downwardly to define the closed box having an upper opened end for receiving concrete and a lower opened end with a vertically disposed opened mouth defined by the vertical edges of the side walls and the lower edge of the rear wall, with the lower opened end having a smaller cross-sectional area than the upper opened end; and a screed for slip-forming the concrete, means for removably securing the screed at its edges to the side walls below the rear wall with the forward end of the screed being positioned at the opened mouth of the rear wall.

7 Claims, 5 Drawing Sheets

CONCRETE PATH PAVER WITH REMOVEABLE SLIP-FORMING SCREED

BACKGROUND OF THE INVENTION

1. Field of the Invention

This invention relates to an improved concrete path paver, and, more particularly, to a concrete paving machine designed to be pulled behind a cement truck to lay a slip-formed path of concrete on the ground as the concrete is dispensed from the cement truck through the machine, the machine including a removable screed, adjustable sides and stabilizing fins.

2. Description of the Background Art

Presently there are a wide variety of paving machines designed to lay a path or roadway. Some machines are designed for laying concrete, others for laying asphalt. Typically, the bed of the path or roadway must be prepared prior to laying the material. The material must provide adequate support for the path or roadway. For heavy roadways, the bed is prepared with aggregate and aggregate compositions to provide greater load-bearing support for the roadway. For lighter applications, however, such as cart paths on golf courses, the pathway must only be cleared of grass and trees and leveled to a limited degree. For heavy roadways, the bed is generally flat with minimum curves. For golf course paths, the bed may be hilly with sharper curves.

A large number of devices are known for the dispensing of material onto the surface to be paved. By way of example, note my prior patent, U.S. Pat. No. 4,878,778 issued Nov. 7, 1989, directed to a concrete path paver. That patent relates to apparatus for dispensing concrete to form paths. Such apparatus, however, is a large, high-profile unit. In addition, like all prior pavers, such machine is capable of dispensing concrete at only one particular width. Furthermore, known pavers have a tendency to shift sideways when being pulled and not to faithfully follow the movement of its pulling truck.

Other devices for depositing concrete with the same problems as described above include U.S. Pat. Nos. 2,332,688 to Baily; 2,664,794 to Evans; and 4,609,303 to Shumaker. Beyond these patents, the depositing of particulate material such as asphalt is also disclosed in other prior patents, as for example, U.S. Pat. Nos. 1,767,243 to Kime; 3,246,584 to Lee; 3,456,566 to Lazaro; 3,877,830 to James; 3,989,402 to James; and 4,802,788 to Smith.

None of these patented prior devices, whether that of my prior patent or those of others, whether for concrete, asphalt or other materials, is directed to solving the problems as addressed herein.

The above-mentioned patents disclose paving machines adapted for specific applications. Except for the machine of my own prior patent, none of the disclosed prior paving machines are particularly adapted for laying cart paths on golf courses. With regard to golf cart paths in particular, it is desirable to minimize damage to the grass turf of the golf course except beneath the intended path to be paved. No prior paving machine can maintain its movement to within the confines of the path to be paved. Further, no prior paving maching is readily convertible to vary the width of the concrete dispensed and the path formed.

Therefore, it is an object of this invention to provide a concrete paving machine which overcomes the inadequacies of the prior art devices and which provides an improvement which is a significant contribution to the advancement of the concrete path paving art.

Another object of this invention is to provide a paver for slip-forming a path of concrete onto a pathway the upper surface of which constitutes a plane of construction, comprising in combination a box having an exterior front wall and an interior front wall extending downwardly at an angle through the box to the plane of construction, and a rear wall extending downwardly at an angle through the box to a location above the plane of construction, and opposing side walls coupling the front and rear walls extending downwardly to the plane of construction to define the closed box having an upper opened end for receiving concrete and a lower opened end with a vertically disposed opened mouth defined by the vertical edges of the side walls and the lower edge of the rear wall, with the lower opened end having a smaller cross-sectional area than the upper opened end; a screed for forming the concrete, means for securing the screed at its edges to the side walls adjacent to the lower edge of the rear wall with the forward end of the screed being positioned at the opened mouth; shoes removably positionable interiorly of the side walls and exteriorly of the screed to reduce the width of the path being formed; a ski formed by the bends in the exterior front wall and secured at its edges to the side walls across the lowermost front edge of the box, the plate being angled to create a ski-like effect upon movement of the paver on the pathway; a pair of skids affixed to a lowermost edges of the sidewalls causing the box to float upon the pathway during movement of the paver; fins extending downwardly from the box to stabilize the movement of the paver; and hitch means connected to the front of the box allowing the paver to be connected immediately behind a cement truck by means of a chain such that concrete being dispensed from the chute of a cement truck pulling the apparatus flows into the upper opened end of the box while the screed forms the concrete from the opened mouth of the lower opened end into a concrete path laid directly on the pathway.

Another object of this invention is to pave a concrete path with machinery capable of laying a path at one of a plurality of widths.

Another object of this invention is to pull paving apparatus in a path which faithfully follows the direction of the cement truck which is pulling it.

The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with the specific embodiment shown in the attached drawings. For the purpose of summarizing the invention, the invention may be incorporated into a paver for slip-forming a path of concrete onto a pathway the upper surface of which constitutes a plane of construction, comprising in combination a box having an exterior front wall and an interior front wall extending downwardly at an angle through the box to the plane of construction, and a rear wall extending downwardly at an angle through the box to a location above the plane of construction, and opposing side walls coupling the front and rear walls extending downwardly to the plane of construction to define the closed box having an upper opened end for receiving concrete and a lower opened end with a vertically disposed opened mouth defined by the vertical edges of the side walls and the lower edge of the rear wall, with the lower opened end having a smaller cross-sectional area than the upper opened end; a screed for forming the concrete, means for securing the screed at its edges to the side walls adjacent to the lower edge of the rear wall with the forward end of the screed being positioned at the opened mouth; shoes removably positionable interiorly of the side walls and exteriorly of the screed to reduce the width of the path being formed; a ski formed by the bends in the exterior front wall and secured at its edges to the side walls across the lowermost front edge of the box, the plate being angled to create a ski-like effect upon movement of the paver on the pathway; a pair of skids affixed to a lowermost edges of the sidewalls causing the box to float upon the pathway during movement of the paver; fins extending downwardly from the box to stabilize the movement of the paver; and hitch means connected to the front of the box allowing the paver to be connected immediately behind a cement truck by means of a chain such that concrete being dispensed from the chute of a cement truck pulling the apparatus flows into the upper opened end of the box while the screed forms the concrete from the opened mouth of the lower opened end into a concrete path laid directly on the pathway.

Further, the invention may be incorporated into apparatus for slip-forming concrete to form a path comprising in combination a box having a front wall extending downwardly through the box, and a rear wall extending downwardly at an angle through the box to a location above the front wall, and opposing side walls coupling the front and rear walls extending downwardly to define the closed box having an upper opened end for receiving concrete and a lower opened end with a vertically disposed opened mouth defined by the vertical edges of the side walls and the lower edge of the rear wall, with the lower opened end having a smaller cross-sectional area than the upper opened end; and a screed for slip forming the concrete, means for removably securing the screed at its edges to the side walls below the rear wall with the forward end of the screed being positioned at the opened mouth of the rear wall.

The box has an exterior front wall and an interior front wall defining a closed chamber therebetween. The exterior front wall includes a ski formed by bends therein to create a ski-like effect upon movement of the paver on the pathway. The apparatus further includes a pair of skids affixed to a lowermost edges of the sidewalls causing the box to float upon the pathway during movement of the paver. The apparatus further includes fins extending downwardly from the box to stabilize the movement of the paver. The apparatus further includes means to vary the curvature of the screed.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific embodiment may be readily utilized as a basis for modifying or designing other structures for carrying out the same purposes of the present invention. It should be realized by those skilled in the art that such equivalent structures do not depart from the spirit and scope of the invention as set forth in the appended claims.

BRIEF DESCRIPTION OF THE DRAWINGS

For a fuller understanding of the nature and objects of the present invention, reference should be had to the following detailed description taken in conjunction with the accompanying drawings in which.

Similar reference characters refer to similar parts throughout the several Figures.

DETAILED DESCRIPTION OF THE PREFERRED EMBODIMENT

Figure 1:
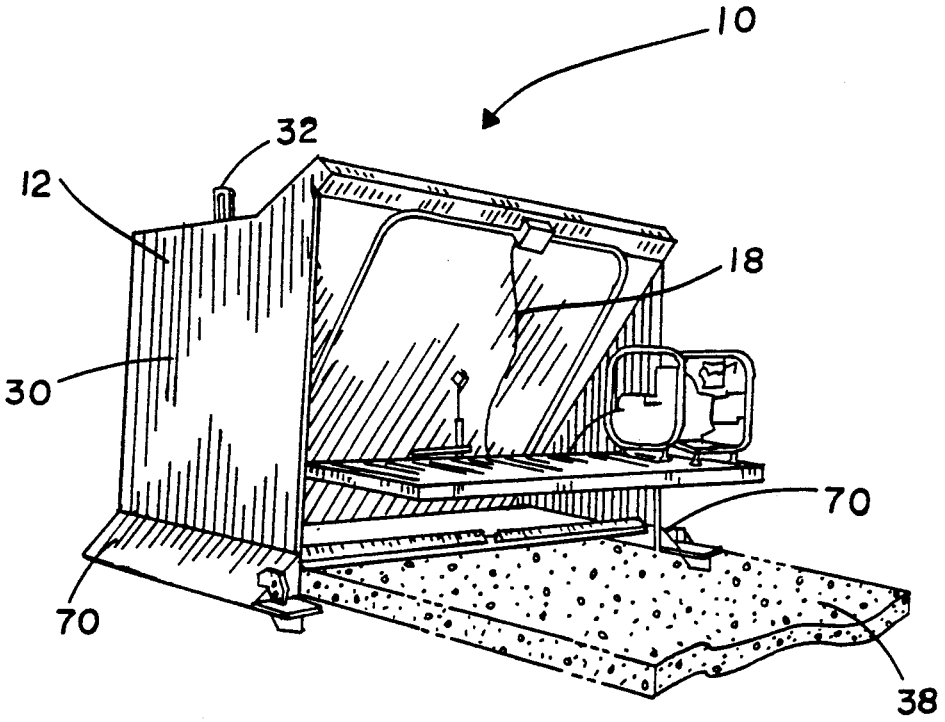
FIG. 1 is a perspective illustration of the rear end and left side of a concrete path paver constructed in accordance with the principals of the present invention.
Figure 2:
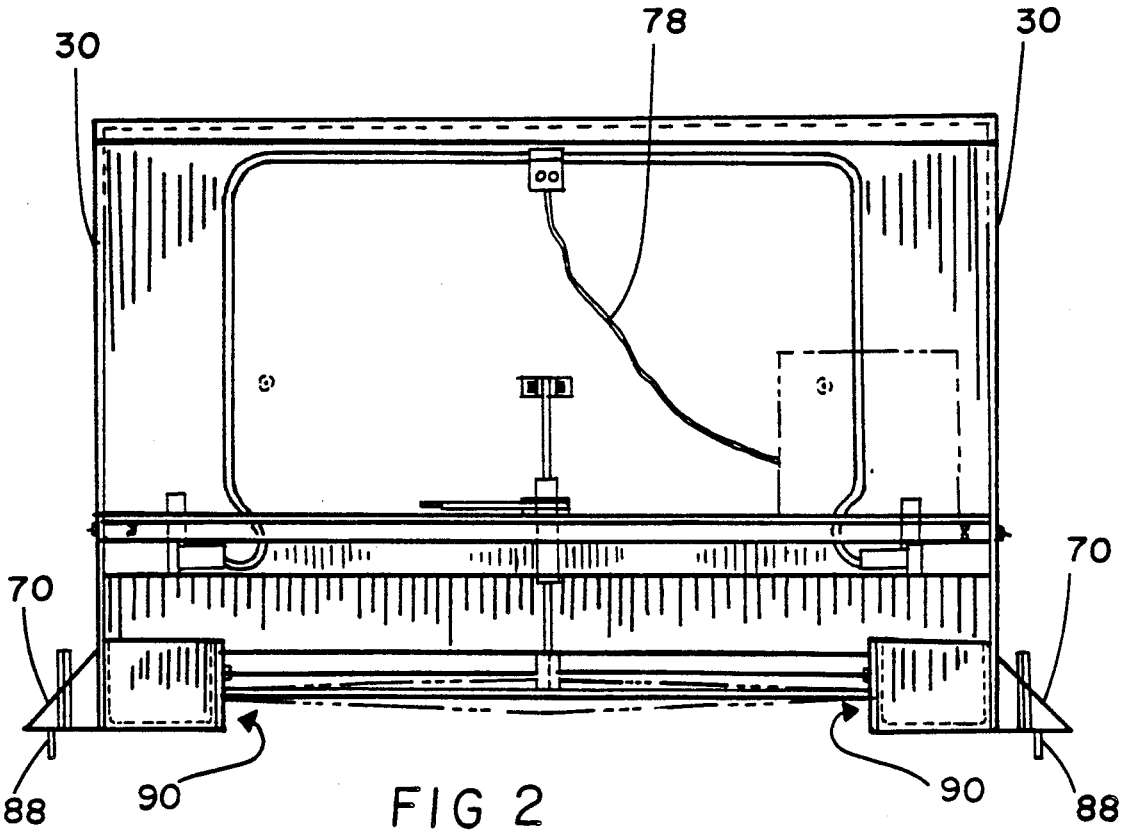
FIG. 2 is a rear elevational view of the apparatus shown in FIG. 1.
Figure 3:
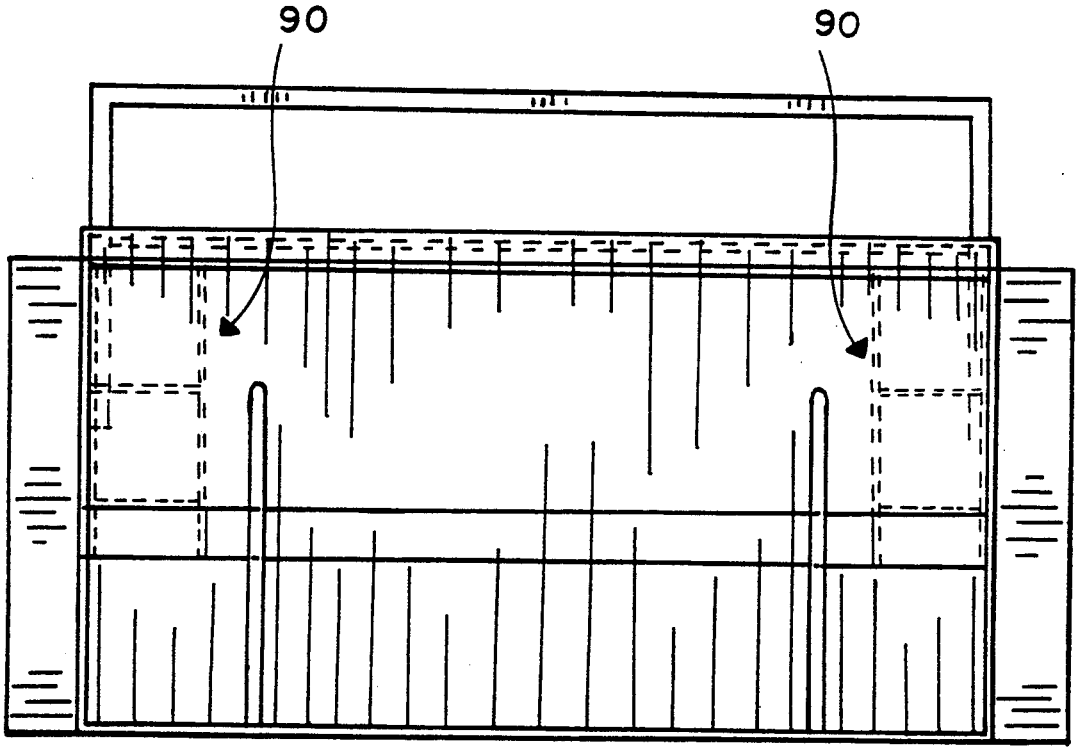
FIG. 3 is a top plan view of the apparatus shown in FIGS. 1 and 2.
Figure 4:
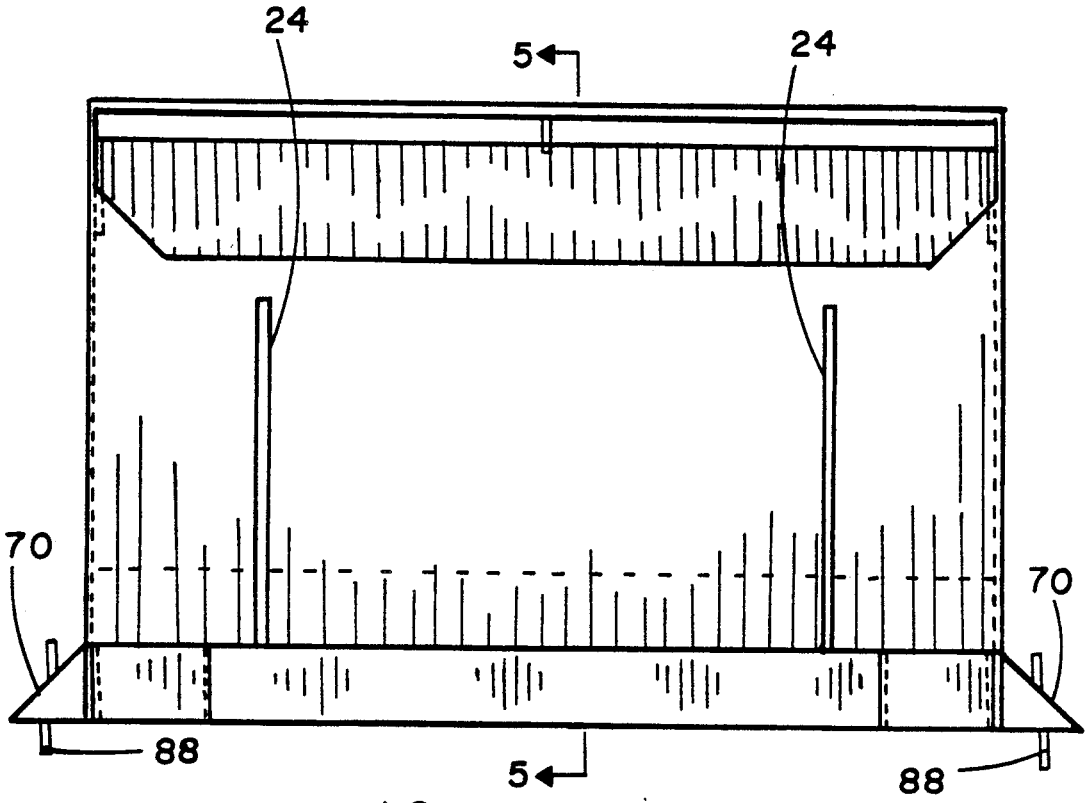
FIG. 4 is a front elevational view of the apparatus shown in FIGS. 1 through 3.
Figure 5:
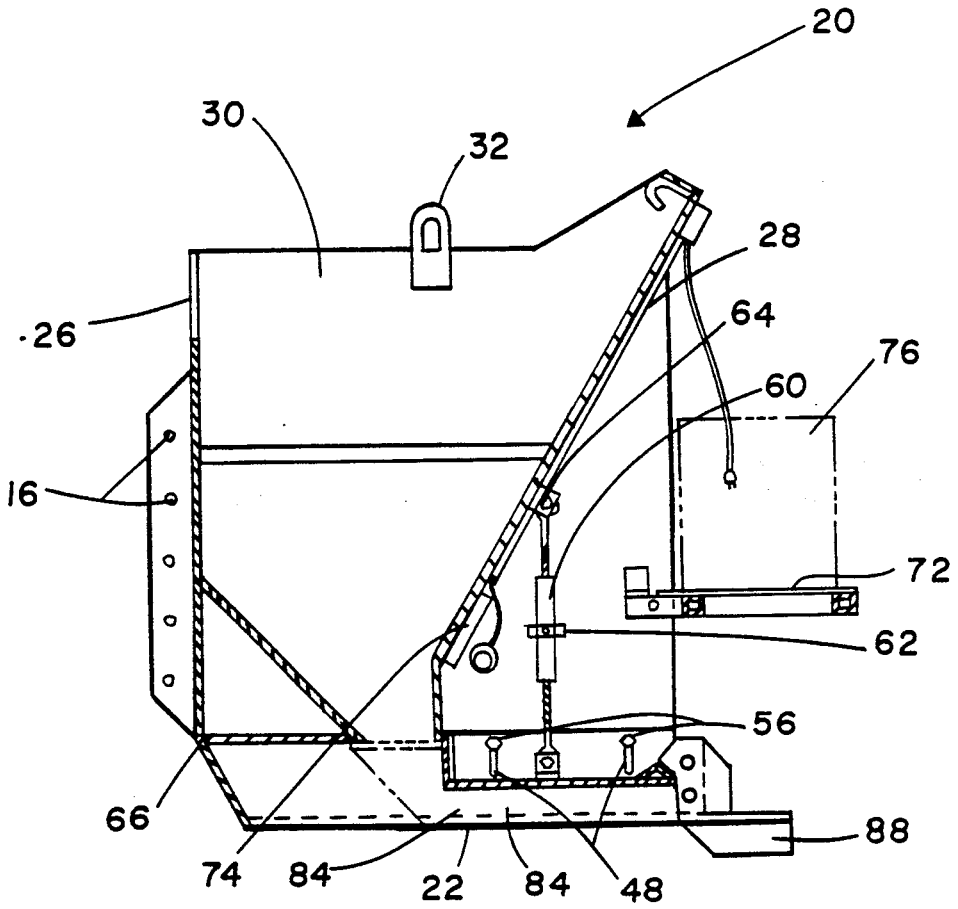
FIG. 5 is a sectional view of the apparatus taken along line 5—5 of FIG. 4.
Figure 6:
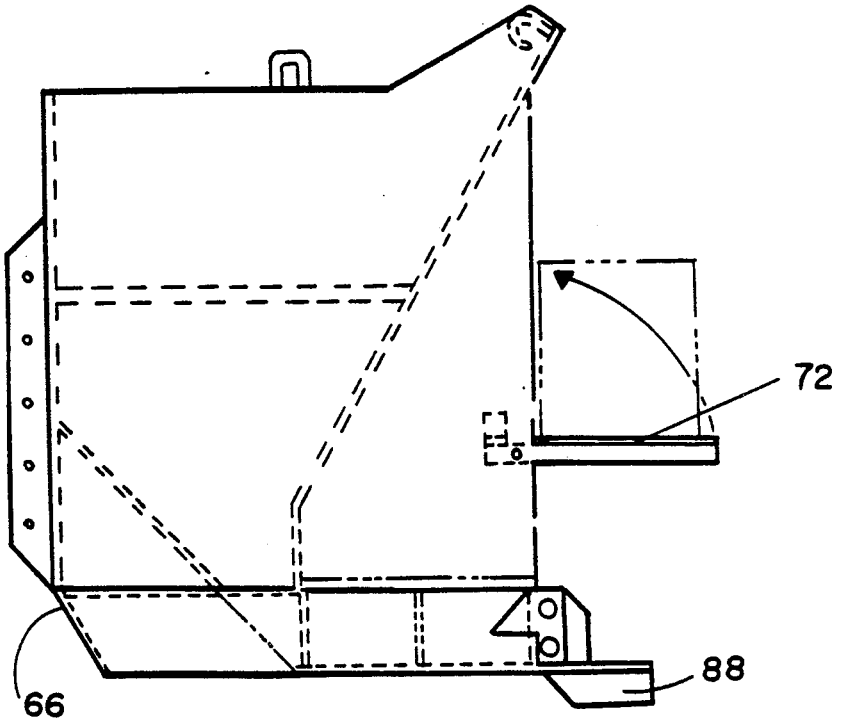
FIG. 6 is a left side elevational view of the apparatus shown in the prior figures.
Figure 8:
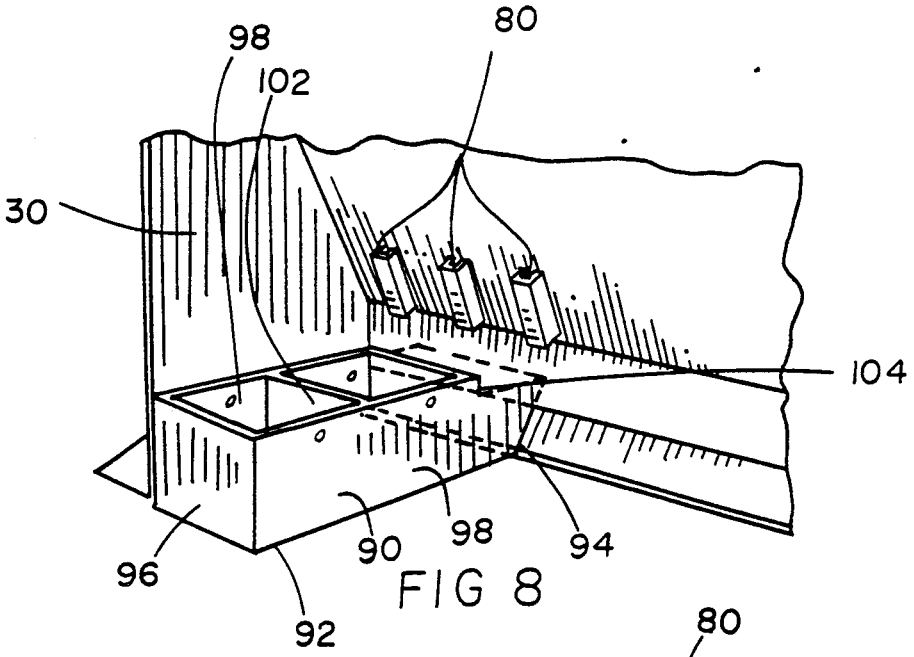
FIG. 8 is a perspective view similar to FIG. 7 but with the shoe separated therefrom.
Figure 7:
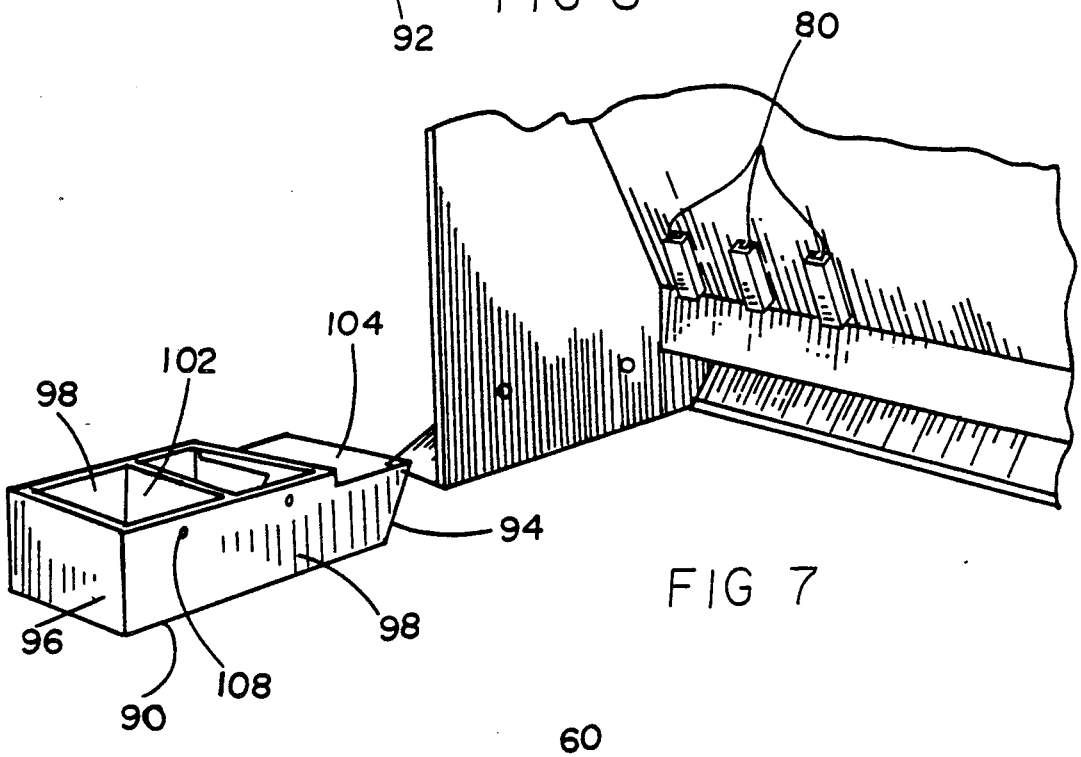
FIG. 7 is an enlarged perspective showing of a portion of the lower rear part of the apparatus of the prior figures showing, coupled therewith, a shoe for varying the width of the concrete slab to be formed.
Figure 9:
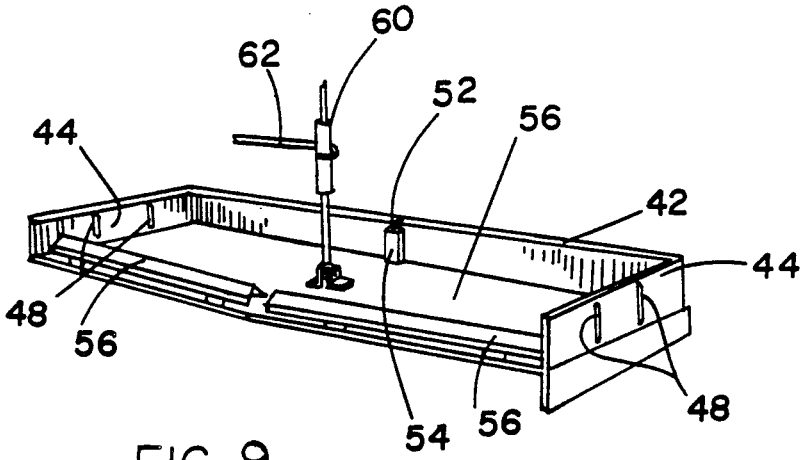
FIG. 9 is a perspective view of the screed removed from the lower rear of the apparatus.
Figure 10:
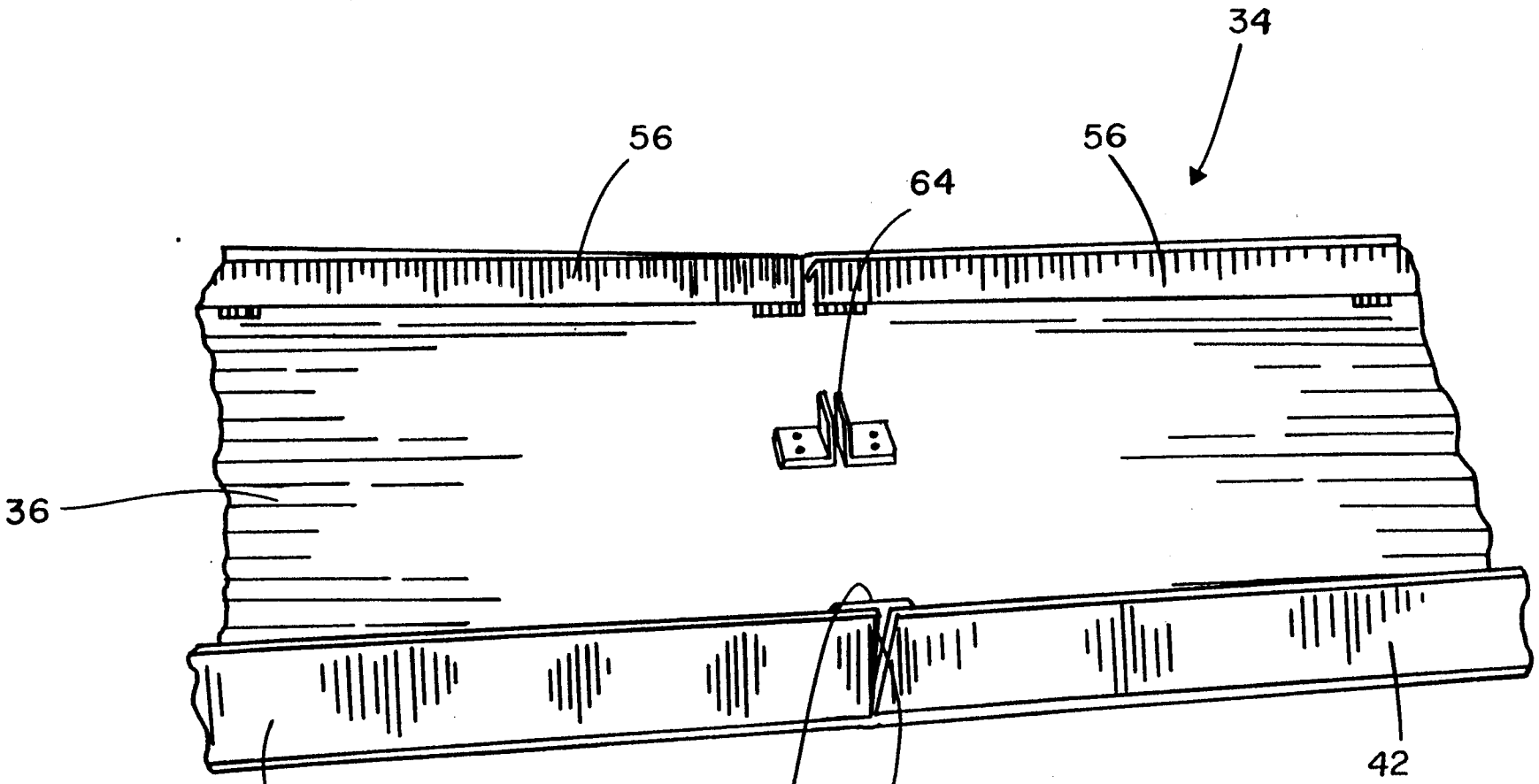
FIG. 10 is an enlarged perspective showing of the central portion of the screed shown in FIG. 9.

With reference to FIG. 1, the concrete path paver apparatus 10 of the present invention comprises a generally rectangular box 12. The box 12 is designed to be pulled by a chain connected to a hitch behind a cement truck, not shown. The chain connects to the box 12 through a pair of pull plates 14 extending forwardly from the front of the box 12. Each pull plate 14 has a plurality of vertically aligned holes 16 for receiving the chain for pulling at one of a plurality of heights for effecting stable movjement of the box as a function of the load, speed, ground conditions, etc.

Depositing cement from the truck into the apparatus 10 being pulled by the truck will slip-form a slab of concrete onto the ground as concrete is dispensed from the chute of the truck into an upper open end 20 of the box 12 and is then deposited by the lower open end 22 of the box 12.

The upper open 20 end of the box 12 is defined by a vertical front wall 26 and a generally complimentary inner sloping rear wall 28. Parallel side walls 30 couple the front and rear walls 28. The upper edges of the front 26 end rear walls 28 and the upper edges of side walls 30 define the upper open end 20. The width of the front 26 and rear walls 28 defines the width of the box 12 as well as the width of the upper open 20 end and the lower open end 22. Horizontal rods 24 couple the central extents of the front 26 and rear walls 28 for bracing support during operation and use. Ears 32 extend upwardly from the side walls 30 for facilitating the lifting of the apparatus 10.

The side walls 30 and front 26 and rear walls 28 define, at their lower ends, the lower open end 22 through which the concrete is fed into the mouth of the screed 34. The screed 34 is a generally horizontally extending member 36 projecting rearwardly from the lower edge of the rear wall 28. More specifically, the lower open end 22 is defined by the lower edge of the rear wall 28 which extends only partially toward the bottom of the opposing side walls 30. The bottom edges of the front end side walls 30 extend to the ground level. The lower edge of the rear wall 28, as well as the screed 34, are elevated with respect to the ground. The lower surface of the screed 34, when compared with the lower ends of the front 26 and side walls 30, defines the depth of the concrete slab 38 to be formed.

It is noted that the rear wall 28 and a lower extension constituting the interior front wall 27 are both sloped inwardly with respect to the verticle. The side walls 30 are, however, vertical of a generally rectangular configuration. This allows sufficient distance for the screed 34 to be positioned between the side walls 30 beneath the rear wall 28 without extending beyond the periphery of the box 12. Support is thus provided for the screed 34 at its side edges by the side walls 30.

The screed 34 comprises a horizontal member 36 having a width to fit between the verticle side walls 30. The horizontal member 36 is provided with upturned flanges 42 and 44 at its front and side edges. Slots 48 are formed in the side edges. Bolts 50 extend through the side walls 30 and through the slots 48 of the flanges 42 and 44 and are fitted with nuts. This allows the horizontal member 36 to be adjusted vertically to form a slab 38 of a predetermined height on the construction surface in accordance with the desires of the operator.

The turned flange 42 at the forward edge of the horizontal member 36 extends upwardly for contact with a lower most portion of the rear wall 28. A close fit is thus achieved between the flange 42 and the lower most edge of the rear wall 28 at all heights of the horizontal member 36. Leakage of concrete therebetween is thereby abatted.

The front flange 42 is actually one of two planer members with a slot 52 therebetween. A plate 54 is secured to one of the flange halves 42 and 44 to cover the space therebetween, to preclude the flow of concrete therethrough and to allow the pivoting of the screed 34 halves during adjustment. Similarly, angled reinforcing bars 56 are located at the rearward edge of the horizontal member 36. This construction of flanges 42 and 44 and bars 56 allows for the central portion of the screed 34 to be coupled through an adjusting member formed as a turnbuckle 60, coupling being through clevis brackets 64 at a lower central portion of the rear wall 28 and at an upper central portion of the horizontal member 36. In this manner, rotation of the handle 62 of the turnbuckle 60 allows the central portion of the screed 34 to be raised or lowered, varying the curvature of the screed, to thereby form a slab 38 which is crowned at its center, dished or, in the alternative totally flat. The clevis bracket 64 of the horizontal member 36 are spaced more widely than the clevis bracket 64 of the rear wall 28 to allow for the raising and lowering of the screed 34 without binding.

At the lowest portion of the forward exterior wall 26, the wall angles rearwardly and downwardly. This configuration of the lower front 66 of the apparatus 10 allows the functioning as a ski. The lower most edge of the exterior wall bends rearwardly for being coupled with the lower edge of an angled interior front wall 27. A chamber is thus formed between the interior and exterior front walls and the side walls. The shape of this ski functions to prevent the front of the box 12 from digging into the ground when being pulled instead of sliding along as is required for proper laying of concrete.

A pair of side skids 70 are formed as outward extentions of the side walls 30. The skids 70 extend substantially the full length of the apparatus 10 adjacent to lower extent of the side walls 30. The skids 70 have horizontal cross sections and angled fronts. The skids 70 function to prevent the lower most edges of the side walls 30 from digging into the ground as the apparatus 10 is pulled by the cement truck without significantly adding to the overall width of the apparatus 10.

Extending across the rear of the box 12 is a horizontal platform 72 pivotally supported in the side walls 30 by a pair of brackets. The platform 72 provides a standing area for an operator to work in association with the driver of the cement truck for controlling the flow of concrete into the upper open end 20 of the apparatus 10, through the apparatus 10 and out of the lower end 22 of the apparatus 10 to form the concrete path.

Vibrators 74 are mounted on the exterior surface of the rear wall 28. The vibrators 74 are powered by a suitable apparatus 76, as for example a gasoline engine/-generator positioned on the platform and suitable electric lines 78. The vibrators 74 are slip fit into their supporting brackets 80 formed on the rear face of the rear wall 28 and function to agitate the rear wall 28 for effecting the formation of a slab 38 through the smooth flow of concrete, particularly thick concrete.

During use, as concrete flows from the cement truck into the apparatus 10, the concrete is agitated by the vibrators 74 and then flows onto the ground and into the mouth of the screed 34. The mouth 84 of the screed 34 is at the forward edge of the horizontal member 36. As the apparatus 10 is pulled concurrently with the deposition of concrete a continuing flow of concrete goes into the box 12 and at its upper end 20 and out at its lower end 22 to form a slab 38 of concrete slipped formed on the ground. After the slab 38 is slipped formed, only minimal smoothing and brushing thereof is required to create the final product.

Linear movement of the apparatus 10 during operation for faithfully following the direction of movement of the cement truck which is pulling the apparatus 10 is insured by a pair of fins 88. The fins 88 are secured to lower, rearward portions of the skids 70. The fins 88 have rearwardly angled front edges which dig into the ground beyond the sides of the concrete slab 38 being formed. They retain the box 12 on a straight line path as determined by the direction of the pulling cement truck and minimize inadvertant.lateral movement or drift as may occur through normal operation. Concrete paths for golf courses are usually formed on ground which, when compared with roadways for cars, is more hilly and curving and has trees, shrubs, etc. to divert the paving apparatus 10 from its intended direction of movement as defined by the concrete truck which is pulling it. The fins 88 are vertically oriented, parallel with each other, at locations outboard of the side walls 30. This orientation maximizes the stability of the box 12 during operation and use.

As can be seen in FIGS. 7 through 10, the screed 34 of the apparatus 10 of the present invention is separable from the remainder of the apparatus 10. Extending upwardly at its edges are flanges 42 and 44 having two vertical slots 48 adapted to couple with two bolts 50 extending through horizontally aligned holes 16 in the side walls 30 of the apparatus 10. Elevational adjustment of the screed and path to be formed is thus accomplished. Operatationally coupled with the height adjusting screed is the use of blocks-out shoes or blocks 90 to allow a larger machine to lay down concrete of a lesser width. Such block-out shoes 90 are generally rectangular on their lower face 92. Front and rear faces 94 and 96 are located at the front and rear faces of the screed 34. Side faces 98 are parallel with each other and at a distance equal to the width of concrete not to be laid down. The top is open for saving weight and expense. The front face 94 of each shoe 90 is angled downwardly for forming a smooth continuation with the interior face of the intermediate plate 54. A brace or braces 102 is provided within each shoe 90 for rigidity, and a notch 104 is formed in the forward edge of each shoe 90 for mating with the lower edge of the front wall 26.

Each side edge is provided with bolt holes. The bolt holes 108 on the exterior sides 98 of the shoes 90 adjacent to the side plates are for mounting with the bolt holes 108 of the side plates 54. Bolt holes 108 on the exterior side edges of the shoes are for coupling with the side flanges 42 and 44 of the screed 34 to provide its support. The holes of the screed 34 are actually vertically oriented slots for allowing the raising and lowering of the screed 34 and shoes 90 to effect the laying of the concrete slab 38 to a predetermined height.

In addition to allowing for varying heights of concrete through the screed 34 construction, the shoes 90 allow for varying widths of the concrete slab 38. A screed 34 of a width equal to the width of the machine may be utilized without shoes 90 to allow for the laying of the widest path to be provided by the paving apparatus 10. In the alternative, a screed 34 of lesser width may be utilized in association with one, two or more blocks 90 on each side between the screed 34 and the side plates 54 to preclude the laying of concrete in the region where the shoes 90. This width varying capability extends the utility of the apparatus 10.

The present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described: what is claimed is:

1. A paver for slip-forming a path of concrete onto a pathway the upper surface of which constitutes a plane of construction, comprising in combination:

a box having an exterior front wall and an interior front wall extending downwardly at an angle through the box to the plane of construction, and a rear wall extending downwardly at an angle through the box to a location above the plane of construction, and opposing side walls coupling the front and rear walls extending downwardly to the plane of construction to define the closed box having an upper opened end for receiving concrete and a lower opened end with a vertically disposed opened mouth defined by the vertical edges of the side walls and the lower edge of the rear wall, with the lower opened end having a smaller cross-sectional area than the upper opened end;

a screed for forming the concrete, means for securing the screed at its edges to the side walls adjacent to the lower edge of the rear wall with the forward end of the screed being positioned at the opened mouth;

shoes removably positionable interiorly of the side walls and exteriorly of the screed to reduce the width of the path being formed;

a ski formed by the bends in the exterior front wall and secured at its edges to the side walls across the lowermost front edge of the box, the plate being angled to create a ski-like effect upon movement of the paver on the pathway;

a pair of skids affixed to a lowermost edges of the sidewalls causing the box to float upon the pathway during movement of the paver;

fins extending downwardly from the box to stabilize the movement of the paver; and hitch means connected to the front of the box allowing the paver to be connected immediately behind a cement truck by means of a chain such that concrete being dispensed from the chute of a cement truck pulling the apparatus flows into the upper opened end of the box while the screed forms the concrete from the opened mouth of the lower opened end into a concrete path laid directly on the pathway.

2. Apparatus for slip-forming concrete to form a path comprising in combination:

a box having a front wall extending downwardly through the box, and a rear wall extending downwardly at an angle through the box to a location above the front wall, and opposing side walls coupling the front and rear walls extending downwardly to define the closed box having an upper opened end for receiving concrete and a lower opened end with a vertically disposed opened mouth defined by the vertical edges of the side walls and the lower edge of the rear wall, with the lower opened end having a smaller cross-sectional area than the upper opened end; and a screed for slip-forming the concrete, means for removably securing the screed at its edges to the side walls below the rear wall with the forward end of the screed being positioned at the opened mouth of the rear wall.

3. The apparatus as set forth in claim 2 wherein the box has an exterior front wall and an interior front wall defining a closed chamber therebetween.

4. The apparatus as set forth in claim 3 wherein the exterior front wall includes a ski formed by bends therein to create a ski-like effect upon movement of the paver on the pathway.

5. The apparatus as set forth in claim 2 and further including a pair of skids affixed to a lowermost edges of the sidewalls causing the box to float upon the pathway during movement of the paver.

6. The apparatus as set forth in claim 2 and further including fins extending downwardly from the box to stabilize the movement of the paver.

7. The apparatus as set forth in claim 2 and further including means to vary the curvature of the screed.

* * * * *